United States Patent [19]

Blumenthal

[11] 3,961,487

[45] June 8, 1976

[54] MINE ROOF SUPPORT

[75] Inventor: Gunter Blumenthal, Westerholt, Germany

[73] Assignee: Bochumer Eisenhutte Heintzmonn, & Co., Bochum, Germany

[22] Filed: Sept. 30, 1975

[21] Appl. No.: 618,212

[30] Foreign Application Priority Data

Nov. 9, 1974 Germany ..... 2453257

[52] U.S. Cl. ..... 61/45 D; 248/357

[51] Int. Cl.[2] ..... E21D 15/44

[58] Field of Search ..... 61/45 D; 299/32, 33; 248/357; 91/170 MP

[56] References Cited

UNITED STATES PATENTS

| | | | |
|---|---|---|---|
| 3,342,034 | 9/1967 | Andrews et al. | 61/45 D |
| 3,372,551 | 3/1968 | Von Hippel | 61/45 D |
| 3,649,078 | 3/1972 | Grebe et al. | 299/32 |

FOREIGN PATENTS OR APPLICATIONS

| | | | |
|---|---|---|---|
| 1,224,247 | 9/1966 | Germany | 61/45 D |
| 1,277,172 | 9/1968 | Germany | 299/32 |

*Primary Examiner*—Dennis L. Taylor
*Attorney, Agent, or Firm*—Michael J. Striker

[57] ABSTRACT

A mine roof support has at least two elongated support members laterally adjacent one another and extending transverse to the mine face. Each of the support members has an underside, a first end portion facing towards and a second end portion facing away from the mine face. A shield arrangement is mounted on the second end portions and extends upwardly thereof for supporting the mine roof. An extension arrangement is connectable to the first end portions of the support members with limited freedom of pivoting movement in vertical direction, and includes a ground plate extending to all of the support members and inclined relative to the undersides thereof, and terminal portions which rise upwardly towards the mine face in the region of the free ends of the first end portions of the support members.

10 Claims, 4 Drawing Figures

MINE ROOF SUPPORT

BACKGROUND OF THE INVENTION

The present invention relates to a mine roof support.

Mine roof supports are known having ground-contacting support members which are arranged in parallelism to one another spaced lengthwise along the mine face, each having a first end portion facing towards the mine face and a second end portion facing away from the mine face. On the second end portions are mounted upright support elements which carry the actual mine roof shield. The reason why the ground-contacting support members are provided as separate elements, rather than a single element, is to make it possible to adjust the mine roof support more readily to particular characteristics of the environment, i.e., of the underground mine passage. The individual support members are always spaced from one another so that the free area between them can accommodate devices for guiding and advancing the mine roof support as a whole, or for conveyor or similar feeding devices. Also, the channel-like regions between the adjacent support members have in effect a self cleaning effect since rubble which collects forwardly of the mine roof supports can be removed rearwardly through these channels.

The end portions of the support members which face the mine face taper in that direction to a flat configuration, so that the mine roof support can be moved forwardly towards the mine face and the flat portions of the support members can extend beneath, for example a conveyor which extends along the bottom edge of the mine face, so that the front edge of the shield is immediately adjacent to the mine face at the upper end of the same.

Under certain circumstances it has been found that the relatively narrow support members are subjected to very strong surface pressures and therefore penetrate undesirably into the floor of the mine gallery. This could be counteracted by connected the individual support members with appropriate braces or the like, but that would block the channels between them and would prevent the rearward removal of rubble and the like. Furthermore, the integration of guiding and advancing devices for the mine roof support into such a structure would then cause considerably difficulties, and an adjustment possibility to compensate for unevenness of the floor of the mine gallery, which presently exists, would be lost.

It has also been found that in the prior-art constructions the shield of the mine roof support tends to "stick" to the mine roof. This makes it possible for the support members to tilt or yield rearwardly about the pivot axis at which the mine roof shield is connected to the upright of the mine roof support structure. In that case, the free front ends of the support members perform a substantially part-circular movement, the center of the circle being formed by the pivot axis at which the upright of the mine roof support is connected to the mine roof shield. As a consequence, this type of construction has a tendency to be largely supported on the free front ends of the support members, which in turn furthers the tendency of the support members to penetrate into the floor of the mine gallery, especially during the advancement of the mine roof support (which is usually of the walking type) towards the mine face. During the subsequent attempt at advancement, i.e., after such penetration, the penetration prevents or at least substantially hinders the further advancement. At the very least, successive advancements cause the free front ends to penetrate successively deeper into the floor of the mine gallery and to gouge deep grooves into it.

SUMMARY OF THE INVENTION

It is, accordingly, a general object of this invention to overcome the aforementioned disadvantages.

More particularly, it is an object of the present invention to provide an improved mine roof support in which a penetration of the support members of the mine roof support into the floor of the mine gallery is reliably prevented, even if the floor is rather soft.

Another object of the invention is to provide such a mine roof support in which the support can be moved forwardly towards the mine face without any difficulties.

In keeping with these objects, and with others which will become apparent hereafter, one feature of the invention resides in a mine roof support which, briefly stated, comprises at least two elongated support members laterally adjacent one another and extending transverse to the mine face. Each of the support members has an underside, a first end portion facing towards and a second end portion facing away from the mine face. Shield means is mounted on the second end portions and extends upwardly thereof for supporting the mine roof. Extension means is connectable to the first end portions of the support members with limited freedom of pivoting movement in vertical direction and includes a ground plate extending to all of the support members and inclined relative to the undersides thereof, and terminal portions which rise upwardly towards the mine face in the region of the free ends of the first end portions of the support members.

In such a construction, the surface area over which the weight of the mine roof support is distributed, is substantially larger than in the prior art, because the ground plate extends to all of the support members. This reduces the pressure per unit surface area and consequently reduces the tendency to penetrate into the floor of the mine gallery. Furthermore, the surface area in the region of the front end portions or first end portions of the support members is increased, but the region intermediate the adjacent support members remains free since the ground plate is only beneath the support members, so that guiding and moving arrangements can be incorporate as before. Also, the channel between the adjacent support members remains free for removal of rubble in rearward direction. The upwardly inclined terminal portions are present only in the region of the support members themselves and have a width which corresponds to the width of the first end portions of the support members.

Since the ground plate is significantly inclined relative to the undersides of the support members, the extension means forms anchoring surfaces which cooperate with the floor of the mine gallery and assure, if the shield of the mine roof support is in firm contact with the mine roof, that a pivoting of the type so prevalent in the prior art is avoided. The friction resulting from this interaction is greater than the friction between the shield and the mine roof, so that the effect which allows the support members to pivot about their front ends in the prior art, no longer exists. This prevents an undesired inclination of the support members relative to the floor of the mine gallery.

Also, in combination with the substantial inclination of the ground plate relative to the undersides of the support members, and in combination with the upwardly inclined terminal portions, it is assured that during the forward advancement of the mine roof support towards the mine face a penetration into the floor of the mine gallery is avoided.

Furthermore, due to the limited vertical pivoting of the extension means relative to the support members the advantage is obtained that the mine roof support can more readily accommodate itself to the particular circumstances prevailing in the mine gallery. For example, if the mine roof support has the tendency to support itself on the free ends of the first end portions of the support members, then the extension means—having limited vertical pivoting capability—does not follow the movement of the mine roof support and instead assumes an angle relative to the floor of the mine gallery and the support members which is different than would otherwise be the case. Thus, it can maintain in surface-to-surface contact with the floor of the mine gallery, exerting a pressure upon the floor which actually tends to compact the floor and sliding over the floor when the mine roof support is advanced forwardly towards the mine face.

Thus, the present invention maintains the adjustability of the support members, reduces the pressure per unit surface area upon the floor of the mine gallery, and facilitates the advancement of the mine roof support in direction towards the mine face. Further, it prevents the support members from pivoting upwardly with their rearward end portions about their free front end portions.

A particularly advantageous embodiment of the invention provides for the limited vertical pivoting capability of the extension means by pivot bolts which are mounted in the tubular free ends of the support members and in corresponding recesses of the extension means, as well as by means of bolts which are mounted in the extension means at the region of the latter facing away from the mine face and which extend in corresponding substantial vertical slots of the support members. These bolts are pushed from the side through corresponding cutouts in the extension means and inserted into the tubular free ends of the support members or into the slots, respectively. The pivot axis of the extension means is thus in the foremost region of the support members, whereas the means for limiting the vertical displacement are spaced in the direction away from the mine face. It is conceivable in this connection that all of the bolts may be temporarily fixed on the extension means, and the construction according to this embodiment permits a very simplified manufacture and assembly and disassembly of the extension means, i.e., connection thereof to the support members and removal when it is not required.

Another advantageous embodiment of the invention suggests that the extension means be provided with lateral vertical boundary walls which are fixedly connected with the bottom plate and with the upwardly inclined terminal portions, and whose inner surfaces are formed in the region of the aforementioned bolts with console-like reinforcements. These boundary walls thus reinforce the extension means and together with the console-like reinforcements assume the journalling functions from the various ports. The console-like reinforcements and the boundary walls are formed with cutouts or recesses in which the bolts are journalled. To avoid projecting parts it is further advantageous if the boundary walls are largely accommodated to the profile of the support members.

According to the invention it is also of advantage if the elongated slots in the support members are part-circular, the center of the circle being formed by the pivot axis of the extension means, so that canting is avoided.

The rearward longitudinally extending edge of the bottom plate is advantageously spaced from the underside of the support members, and the spacing is advantageously effected by spacing bars which are welded onto the bottom plate and located between the undersides of the support members and the bottom plate. This assures that the bottom plate will have a differentinclination relative to the flow of the mine gallery than the undersides of the support members, so that the underside of the bottom plate is inclined more strongly relative to the floor, thereby facilitating the upward and forward movement of the mine roof support over the floor as the mine roof support is advanced towards the mine face. This also forms large contact areas with the floor which counteract the tilting of the mine roof support for the reasons outlined earlier with respect to the prior art and which assure that the mine roof support is firm and stable at all times.

To be able to more readily provide guiding and advancing devices between the support members it is advisable according to the present invention if the longitudinal edge of the bottom plate which faces the mine face is arranged approximately in a vertical longitudinal plane passing through the pivot axis of the extension means, and this front edge advantageously is inclined in the region between the upwardly inclined terminal portions.

To assure self-adjusting pivoting of the extension means relative to the support member even if there is much rubble or removed material at the mine face, a further advantageous characteristic of the invention provides that deflecting baffles be provided at the upper longitudinal edges of the terminal portions which face the mine face, which baffles also extend towards the mine face and extend over the region where bolts are provided. The end portions of these baffles are spaced vertically at a slight distance from the upper side of the support members in order not to interfere with the pivotal adjustment of the extension means relative to the support members. On the other hand, the baffles prevent the accumulation of rubble or other material which might interfere with the pivotal adjustment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
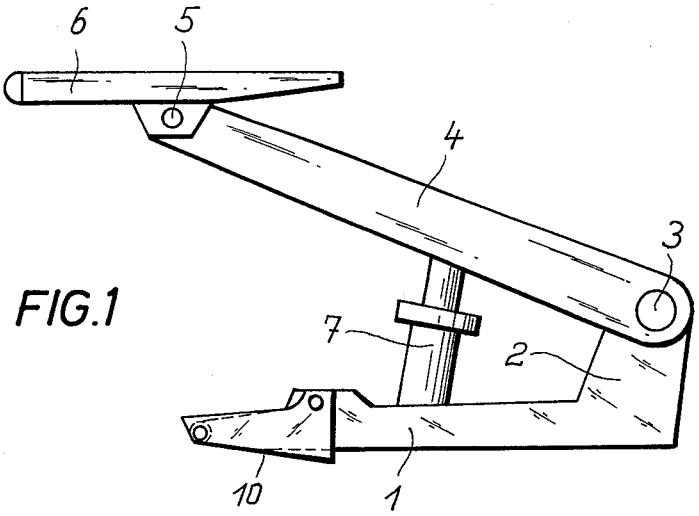
FIG. 1 is a diagrammatic side view illustrating a mine roof support according to the present invention.

FIGS. 1 – 4 show a single exemplary embodiment of the invention. The mine roof support in these Figures is provided with two support members 1 which extend in parallelism to one another and are spaced from one another lengthwise of a mine gallery (not shown) and the mine face therein. The support members 1 are connected with one another in such a manner that each can adjust itself individually relative to unevennesses of the floor of the mine gallery. The rear or trailing end portions 2 of the support members 1 extend upwardly. A one-piece or multi-piece mine roof shield 4 is pivoted to these end portions 2 by a pivot axis 3 and extends over the support members 1 in the direction towards the mine face. The free end of the shield 4 carries a roof-engaging cap or shield member 6 which is connected to it for pivotal movement about a horizontal pivot axis 5. One or more vertical hydraulic pit props 7 which can be extended or retracted act between the support members 1 and the shield 4 so that the latter can be raised or lowered as desired.

Figure 2:
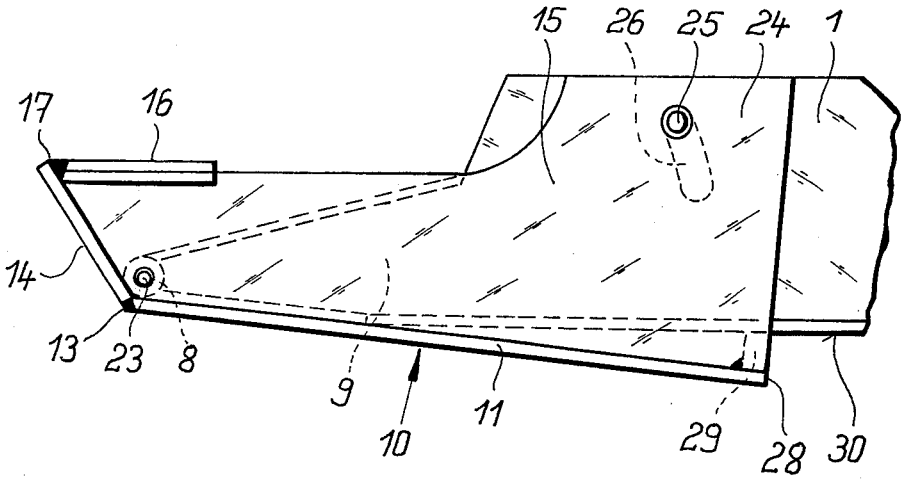
FIG. 2 is an enlarged fragmentary side-elevational detail view of FIG. 1.
Figure 3:
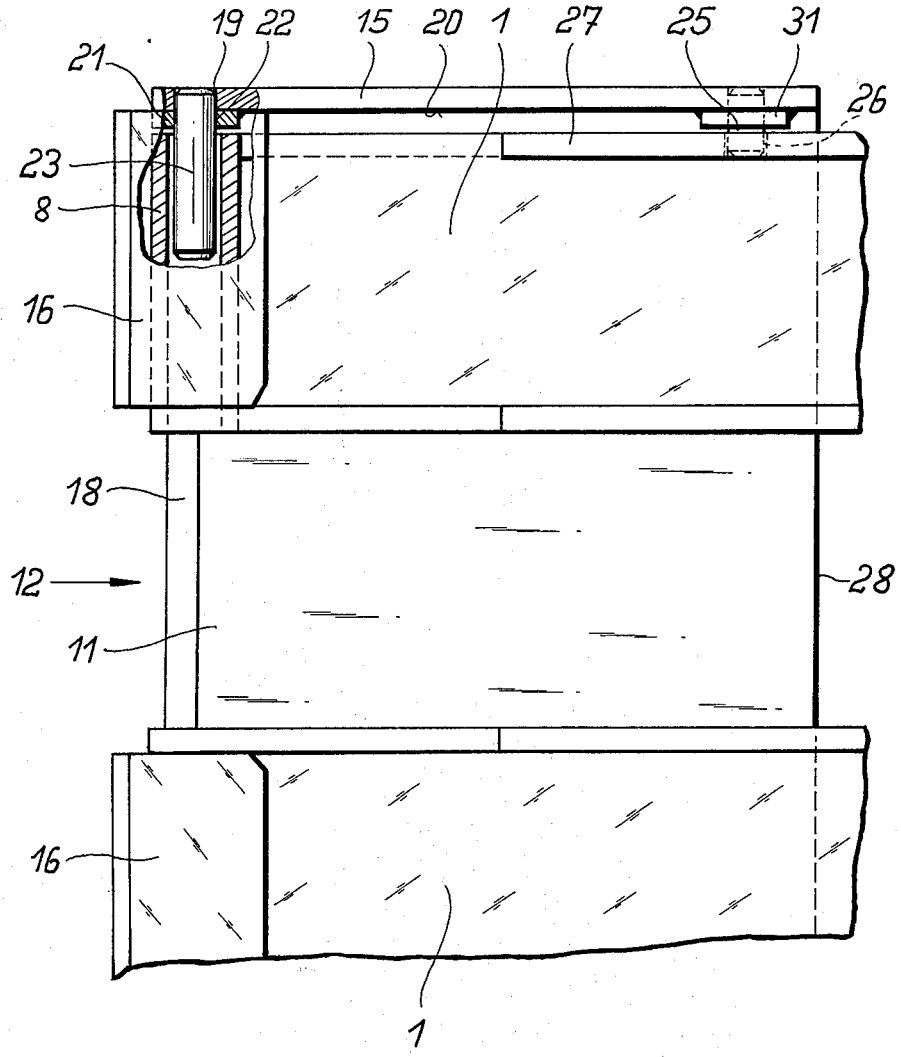
FIG. 3 is a top-plan view of FIG. 2.

As particularly FIGS. 2 and 3 show most clearly, the forward end of the support members 1, i.e., the end directed towards the mine face, is provided with a tubular portion 8 whose width corresponds approximately to the width of the support member 1 which is slightly upwardly inclined in the free end region 9.

Figure 4:
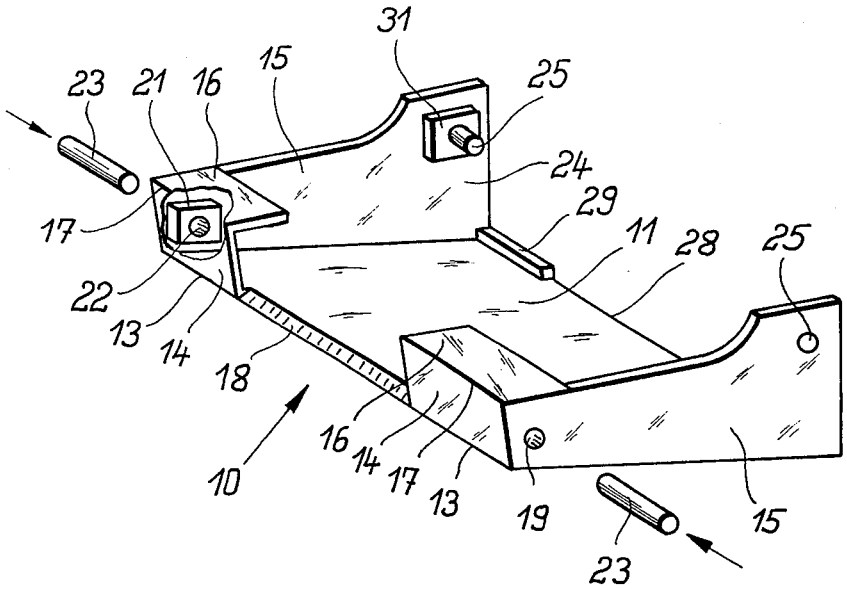
FIG. 4 is a perspective view showing the extension means of the embodiment in FIGS. 1 – 3 on an enlarged scale.

The end regions of the support members 1 carry an extension means 10 which is shown in detail in FIG. 4. The extension means 10 has a closed bottom plate or ground plate 11 which bridges the distance between the adjacent support members 1, thus forming the channel 12 through which rubble may be removed and/or in which guiding and advancing devices for the mine roof support may be mounted. In the region of the support members 1 the longitudinally extending edge portion 13 of the ground plate 11 has welded to it respective terminal portions 14 which are upwardly inclined and have a width corresponding approximately to the width of the support members 1. Both lateral sides of the extension means 10 there is further provided a respective vertical boundary wall 15 which is connected to the plate 11 and to the portions 14, particularly by welding. Further, deflecting baffles 16 are welded to the free longitudinal edges 17 of the portions 14 extending rearwardly away from the mine face. The upper edge 18 of the plate 11 is inclined or beveled intermediate the portions 14.

In the range of transition between the blade 11 and the portions 14 the walls 15 are each provided with a bore 19. At the inner side 20 of the walls 15 the latter are provided in the region of the bores 19 with console-like reinforcements 21 which are welded to the walls 15 and are each also formed with a bore 21 which registers with the respective bore 19. After the extension means 10 is placed onto the support members 1 pivot bolts 23 are pushed through the bores 19, 22 which engage with play into the tubular end portions 8 so that there is a freedom of vertical pivoting of the extension means 10 about the pivot balls 23. This freedom of vertical pivoting is to be limited, however; for this purpose the portion 24 of the walls 15 is provided with bolts 25 which can be inserted into the holes of the walls 15 and fixed therein and which extend into elongated slots 26 formed in the side walls 27 of the support members 1. The slots 26 in this embodiment are arcuately curved about a center which coincides with the pivot axis defined by the bolts 23.

In the region of the edge 28 the plate 11 is provided at the upper side with supporting bars 29, also known as spacing bars, having a width corresponding approximately to the width of the support members 1 and engaging the undersides 30 of the latter, to thus assure that the plate 11 will always be inclined relative to these undersides 30 and can never be pivoted to a position in which its own underside would be located in the same plane as undersides 30. In this position, the bolts 25 are located in abutment with the upper ends bounding the slots 26.

The bolts 25 as well as the bolts 23 are fixedly connected to the walls 15, but can be removed therefrom. This can be done in a simple manner, for example by providing counter nuts at the inner and outer sides of walls 15, or in any manner well known to those skilled in the art. The profile of the boundary walls 15 is largely accommodated, in lateral view, to the profile of the end portions 9 of the support members 1. To provide an additional support for the bolts 25, the inner surfaces 20 of the walls 15 are provided with additional console-like reinforcements, preferably reinforcements which are welded to the walls 15.

It will be understood that each of the elements described above, or two or more together, may also find a useful application in other types of constructions differing from the types described above.

While the invention has been illustrated and described as embodied in a mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mine roof support, comprising at least two elongated support members laterally adjacent one another and extending transverse to the mine face, each of said support members having an underside, a first end portion facing towards and a second end portion facing away from said mine face; shield means mounted on said second end portions and extending upwardly thereof for supporting the mine roof; extension means connectable to said first end portions of said support members with limited freedom of pivoting movement in vertical direction, and including a ground plate extending to all of said support members and inclined relative to said undersides thereof, and terminal portions which rise upwardly towards said mine face in the region of the free ends of said first end portions of said support members.

2. A mine roof support as defined in claim 1, wherein said extension means has an end region facing towards and another end region facing away from said mine face, said other end region having substantially vertically oriented slots, and said support members having bolts extending into said slots with clearance.

3. A mine roof support as defined in claim 2, said extension means having lateral vertical walls rigid with said ground plate and having inner sides facing said support members and formed with reinforcements in the region of said bolts.

4. A mine roof support as defined in claim 3, wherein said first end portions are profiled, and said lateral walls are shaped in substantial conformance with the profiling of said first end portions.

5. A mine roof support as defined in claim 2, wherein said slots are curved on centers coinciding with the pivot axis of said extension means.

6. A mine roof support as defined in claim 1, said ground plate having a rear edge spaced from said mine face and also being spaced in vertical direction from said undersides of said support members.

7. A mine roof support as defined in claim 6; further comprising spacer bars mounted on an upwardly directed surface of said ground plate so as to maintain said rear edge vertically spaced from said undersides.

8. A mine roof support as defined in claim 1, said ground plate having a front edge facing towards said mine face and located substantially in a vertical plane passing longitudinally through the pivot axis of said extension means.

9. A mine roof support as defined in claim 8, said front edge being bevelled intermediate said terminal portions.

10. A mine roof support as defined in claim 1, said terminal portions having upper longitudinal edges adjacent said mine face and provided with deflecting baffles projecting towards said mine face.

* * * * *